United States Patent [19]

Brackmann et al.

[11] Patent Number: 4,911,488

[45] Date of Patent: Mar. 27, 1990

[54] MOTOR-VEHICLE DOOR LATCH WITH BUILT-IN SWITCH

[75] Inventors: Horst Brackmann, Velbert; Peter Barte, Hattingen, both of Fed. Rep. of Germany

[73] Assignee: Kiekert GMBH & Co. Kommanditgesellschaft, Heiligenhaus, Fed. Rep. of Germany

[21] Appl. No.: 278,752

[22] Filed: Dec. 1, 1988

[30] Foreign Application Priority Data

Dec. 2, 1987 [DE] Fed. Rep. of Germany ..... 3740757

[51] Int. Cl.[4] ..... E05B 65/34

[52] U.S. Cl. ..... 292/216; 292/201; 292/341.12; 200/61.68; 200/61.64; 70/434

[58] Field of Search ..... 70/432, 434; 292/201, 292/144, 341.16, 341.12, 216, DIG.56; 200/61.68, 61.67, 61.64

[56] References Cited

U.S. PATENT DOCUMENTS

| | | | |
|---|---|---|---|
| 1,723,956 | 8/1929 | Schuerman | 200/61.68 |
| 2,638,516 | 5/1953 | Forman | 200/61.68 |
| 3,259,708 | 7/1966 | Sandor | 200/61.64 |
| 3,715,536 | 2/1973 | Husch et al. | 200/61.64 |
| 3,757,064 | 9/1973 | Ogawa | 200/61.64 |
| 3,857,001 | 12/1974 | Quantz | 200/61.64 |
| 4,249,161 | 2/1981 | Mohnhaupt | 200/61.67 |
| 4,466,645 | 8/1984 | Kobayshi | 292/216 |
| 4,756,564 | 7/1988 | Ikeda | 292/DIG. 56 |
| 4,806,712 | 2/1989 | Hoffman et al. | 200/61.64 |
| 4,814,557 | 3/1989 | Kato | 200/61.64 |

*Primary Examiner*—Gary L. Smith
*Assistant Examiner*—Eric K. Nicholson
*Attorney, Agent, or Firm*—Herbert Dubno; Andrew Wilford

[57] ABSTRACT

A motor-vehicle door-latch assembly for securing a door to a doorpost invention has a latch fork pivoted on the door, a support mounted on a doorpost, and a bolt projecting from the support and engageable by the fork to retain the door against the doorpost. An electric switch mounted on the support adjacent the bolt is operated by an actuating element engageable by the fork on closing of the door to actuate the switch. Thus the switch can be tucked out of the way inside the post-mounted bolt assembly where it is not exposed to the elements. In addition according to this invention the fork has a curved camming edge which slides over the actuating element. As a result the switch is actuated gently even if the door is slammed, since the camming edge, which typically extends as a spiral centered on the rotation axis of the fork, can reduce a substantial travel of the door to a small travel of the actuating element.

11 Claims, 1 Drawing Sheet

MOTOR-VEHICLE DOOR LATCH WITH BUILT-IN SWITCH

FIELD OF THE INVENTION

The present invention relates to a motor-vehicle door latch. More particularly this invention concerns such a latch provided with a built-in switch.

BACKGROUND OF THE INVENTION

A motor-vehicle door latch typically comprises a bolt attached to and extending perpendicularly from the doorpost and a latch on the door edge. The latch has a pivotal fork that engages around the bolt to secure the door tightly in place. The bolt is typically part of an assembly comprised of a metallic U-shaped yoke having an inner flange adapted to be secured to the doorpost and an outer flange spaced therefrom, forming a fork-receiving space therewith, and having an outer surface turned away from the inner flange. The bolt is also metallic and is fixed to the two flanges so as to extend generally perpendicularly therebetween.

It is standard to provide at each door a switch which is actuated when the respective door is closed to signal to an on-board control system the condition of the door. Thus if a door is not fully closed a lamp on the dashboard will light to warn the driver of this potentially dangerous condition.

As a rule a simple pushbutton switch is employed which is opened when engaged by a flange of the door. It is normally necessary for the door to be fully closed in order for its edge flange to actuate the switch, normally by depressing the button of the switch which projects outward and horizontally in the direction the door moves in when closing.

The problem with this arrangement is that the switch is subjected to considerable physical shocks as the door is closed. In addition it is in a relatively exposed position on the door post. The result is a reduced service life for this switch.

OBJECTS OF THE INVENTION

It is therefore an object of the present invention to provide an improved switch arrangement for a motor-vehicle door latch.

Another object is the provision of such an improved switch arrangement for a motor-vehicle door latch which overcomes the above-given disadvantages, that is which protects the switch from violent shocks and from the elements.

SUMMARY OF THE INVENTION

A motor-vehicle door-latch assembly for securing a door to a doorpost according to this invention has a latch fork pivoted on the door, a support mounted on a doorpost, and a bolt projecting from the support and engageable by the fork to retain the door against the doorpost. An elastic switch mounted on the support adjacent the bolt is operated by an actuating element engageable by the fork on closing of the door to actuate the switch. Thus the switch can be tucked out of the way inside the post-mounted bolt assembly where it is not exposed to the elements. In addition according to this invention the fork has a curved camming edge which slides over the actuating element. As a result the switch is actuated gently even if the door is slammed, since the camming edge, which typically extends as a spiral centered on the rotation axis of the fork, can reduce a substantial travel of the door to a small travel of the actuating element.

In accordance with another feature of this invention the actuating element includes a first plunger directly engageable with the camming edge and displaceable in the direction of movement of the door as it closes and a second plunger engaged between the first plunger and the switch and displaceable transversely of the direction and of the first plunger. This ensures that the switch is completely out of the way, and not actuated in the same direction as the jarring of the door as it closes, so that the problem with the prior-art structures, that a slamming door could just jar the switch into operation, is eliminated.

The support according to the invention includes a U-section yoke having a pair of flanges between which the bolt projects and an elastomer cladding generally filling the yoke between the flanges and formed with a pocket in which the fork engages and another pocket holding the actuating element. The fork has such an elastomeric cladding too.

A spring urges the actuating element toward the bolt and according to the invention the switch includes a pair of normally closed contacts.

DESCRIPTION OF THE DRAWING

The above and other objects, features, and advantages will become more readily apparent from the following, reference being made to the accompanying drawing in which.

SPECIFIC DESCRIPTION

Figure 1:
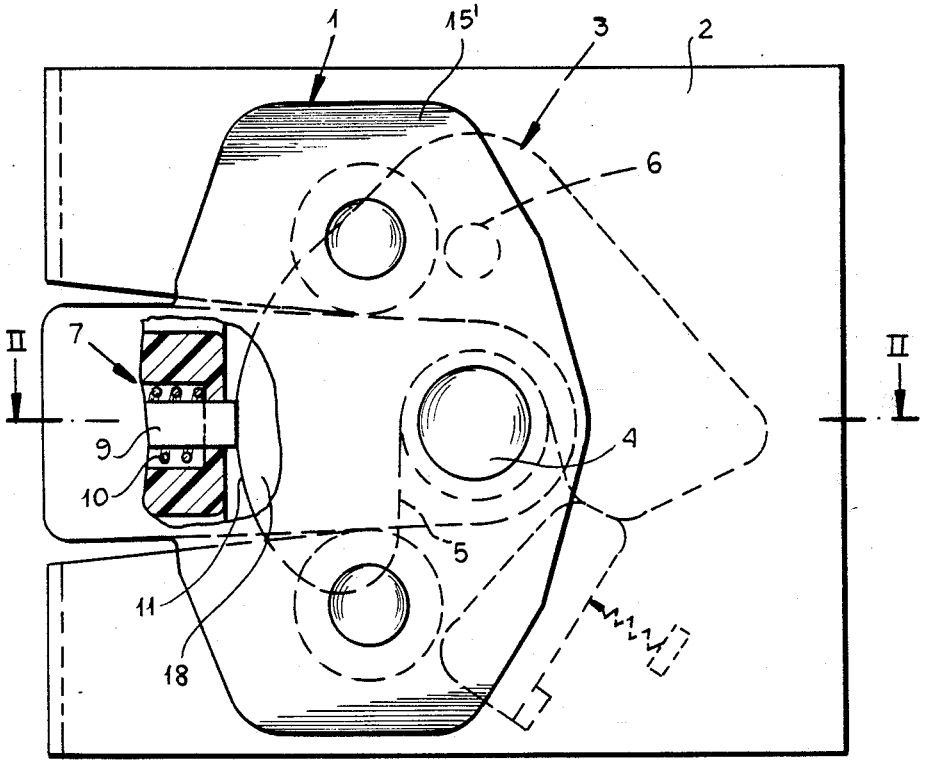
FIG. 1 is a partly sectional view of the latch assembly according to this invention.
Figure 2:
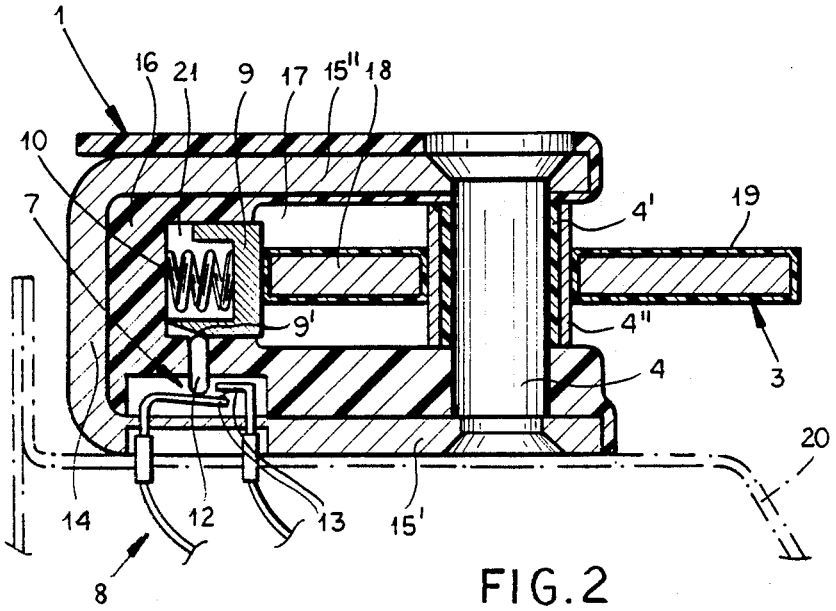
FIG. 2 is a section taken along line II—II of FIG. 1.

As seen in FIGS. 1 and 2 the latch according to this invention comprises a bolt assembly 1 mounted on a doorpost 20 and a latch fork 3 mounted via a pivot pin 6 on a plate 2 secured to a not illustrated door edge. The bolt assembly comprises a U-shaped sheet-metal yoke 14 having a pair of flanges 15' and 15" bridged by a standard latch bolt 4 which is here mounted rivet-fashion in these flanges 15' and 15" and extends perpendicular to them. The flange 15' extends in its own plane as mounting ears that are bolted directly to the vertical surface of the doorpost 20 with the bolt 4 extending parallel to the direction of travel of the vehicle. The steel bolt 4, which is effectively integral with the steel yoke 1, is provided with an elastomerically resilient cover sleeve 4' in turn covered by a somewhat harder wear sleeve 4", for instance of a metal or a synthetic resin such as polyamide or polytetrafluorethylene. In addition the yoke 14 is fitted with a synthetic-resin cladding or cover 16 which fits complementarily over its exposed flange 15" and which fills its interior except for a pocket 17 left to accommodate an inner arm 18 of the fork 3.

The fork 3 in turn has an elastomeric cladding 19 and is formed with a central notch 5 that fits over the bolt, with appropriate angular movement of the fork 3 about the pivot 6, to secure the door in place against the doorpost 20.

According to this invention the cladding body 16 is formed between the flanges 15' and 15" with a pocket 21 in which is slidable a plunger 9 in a direction parallel to the direction of movement of the door when closing, that is perpendicular to the lock bolt 4. A spring 10 urges this plunger 9 outward, that is toward the door and in the direction the door edge moves as it closes, and the fork 3 is formed on its inner edge with a rounded camming surface 11 that extends along a spiral centered on the pivot 6. The plunger 9 is positioned such that as the door latches and the fork 4 pivots into the position of FIG. 1, the surface 11 engages and slides along this plunger 9, pushing it in against the force of the spring 10.

A second plunger 12 extending in the direction of travel of the vehicle and generally parallel to the bolt 4 is slidable in the synthetic-resin mass of the cladding 16. It has one end bearing on an inclined camming surface 9' of the first plunger 9 and an opposite end engaging a switch 7 formed by a pair of contacts 13 fixed in the flange 15'. These contacts 13 are connected via conductors or cabling 8 to the warning-lamp assembly of the vehicle. The second plunger 12 engages and opens the contacts 13 only when the first plunger 9 is fully depressed.

Thus according to this invention as the door closes the fork 3 pivots counterclockwise as seen in FIG. 1, sliding the surface 11 formed by the cladding 19 over the outer end of the first plunger 9 and depressing it. This plunger 9 therefore moves inward and cams the second plunger 12 with its surface 9' perpendicularly, opening the contacts 13 when fully depressed.

The use of the angular camming action of the fork 3 ensures that the switch 7 is opened relatively gently, even if the door is slammed hard. In addition the lateral mounting of the switch 7 makes it possible to use relatively large parts, as there is sufficient room off to the side for a standard-size device. What is more the lateral out-of-the-way mounting of this switch 7 effectively protects it from the elements, even when the door is open.

We claim:

1. A motor-vehicle door-latch assembly for securing a door to a doorpost, the assembly comprising:

a latch fork pivoted on the door;

a support mounted on a doorpost;

a bolt projecting from the support and engageable by the fork to retain the door against the doorpost;

an electric switch mounted on the support adjacent the bolt; and means including an actuating element engaging the switch and engageable by the fork on closing of the door for actuating the switch, wherein the fork has a curved camming edge which slides over the actuating element, the actuating element including a first plunger directly engageable with the camming edge and displacable in the direction of movement of the door as it closes, and;

a second plunger engaged between the first plunger and the swtich and displaceable transversely of the direction and of the first plunger.

2. The motor-vehicle door-latch assembly defined in claim 1 wherein the support includes a U-section yoke having a pair of flanges between which the bolt projects and an elastomeric cladding generally filling the yoke between the flanges and formed with a pocket in which the fork engages and another pocket holding the actuating element.

3. The motor-vehicle door-latch assembly defined in claim 2 wherein the fork also has an elastomeric cladding.

4. The motor-vehicle door-latch assembly defined in claim 1, further comprising spring means urging the actuating element toward the bolt.

5. The motor-vehicle door-latch assembly defined in claim 1 wherein the switch includes a pair of normally closed contacts.

6. A motor-vehicle door-latch assembly for securing a door to a doorpost, the assembly comprising:

a latch fork pivoted on the door;

a support mounted on a doorpost;

a bolt projecting from the support and engageable by the fork to retain the door against the doorpost;

an electric switch mounted on the support adjacent the bolt; and means including an actuating element engaging the switch and engageable by the fork on closing of the door for actuating the switch, the support including a U-section yoke having a pair of flanges between which the bolt projects and an elastomeric cladding generally filling the yoke between the flanges and formed with a pocket in which the fork engages and another pocket holding the actuating element.

7. The motor-vehicle door-latch assembly defined in claim 6 wherein the fork has a curved camming edge which slides over the actuating element.

8. The motor-vehicle door-latch assembly defined in claim 7 wherein the actuating element includes:

a first plunger directly engageable with the camming edge and displaceable in the direction of movement of the door as it closes, and;

a second plunger engaged between the first plunger and the switch and displaceable transversely of the direction and of the first plunger.

9. The motor-vehicle door-latch assembly defined in claim 6 wherein the fork also has an elastomeric cladding.

10. The motor-vehicle door-latch assembly defined in claim 6, further comprising spring means urging the actuating element toward the bolt.

11. The motor-vehicle door-latch assembly defined in claim 6 wherein the switch includes a pair of normally closed contacts.

* * * * *